US005881845A

United States Patent [19]

O'Donnell et al.

[11] Patent Number: 5,881,845

[45] Date of Patent: Mar. 16, 1999

[54] ELEVATOR ROPE PROTECTIVE DEVICE

[75] Inventors: Hugh J. O'Donnell, Longmeadow, Mass.; Eric G. Olsen, Southbury; Randy G. Henley, Danbury, both of Conn.

[73] Assignee: Otis Elevator Comany, Farmington, Conn.

[21] Appl. No.: 851,436

[22] Filed: May 5, 1997

[51] Int. Cl.[6] ..... B66B 7/08

[52] U.S. Cl. ..... 187/411; 187/414

[58] Field of Search ..... 187/411, 414, 187/345, 346; 59/78, 82, 83, 93

[56] References Cited

U.S. PATENT DOCUMENTS 1,048,306 11/1966 Burley ..... 187/411

2,214,139 9/1940 Lindquist ..... 187/411

*Primary Examiner*—Kenneth Noland

[57] ABSTRACT

A protective device for an elevator system extends about a rope and extends upward from an elevator car. The protective device blocks contact with the portion of the rope enclosed by the device. As a result, the risk of damage to the ropes caused by a person, such as a mechanic, who is present on the top of the car, is minimized. The invention is particularly advantageous for synthetic ropes that are subject to damage due to contact with abrasive objects or solvents. In one embodiment, the protective device is a tubular structure formed from a rigid, abrasion resistant material. In other embodiments, the protective device is a sheath formed from an abrasion resistant, woven fiber material that extends about the rope.

15 Claims, 3 Drawing Sheets

FIG.2
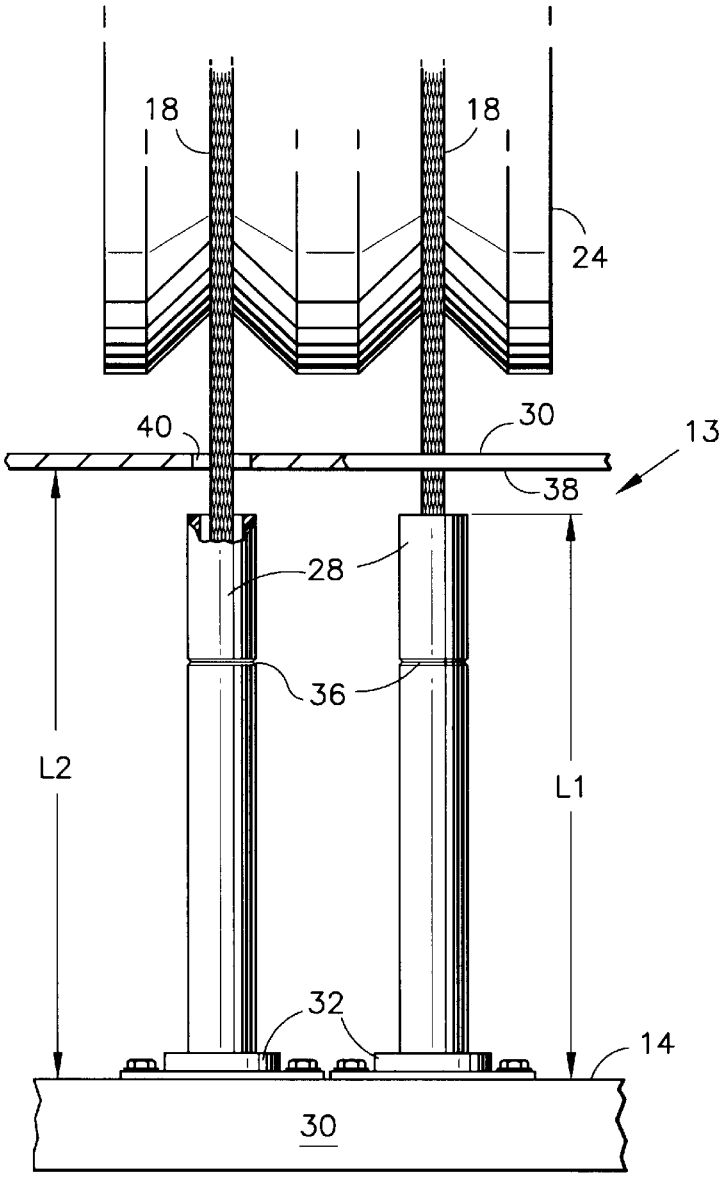
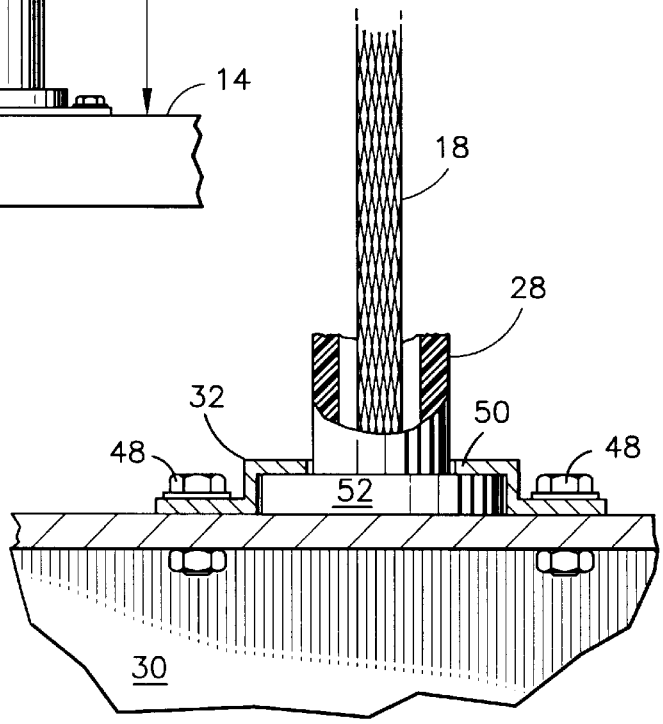
FIG.3

FIG.4
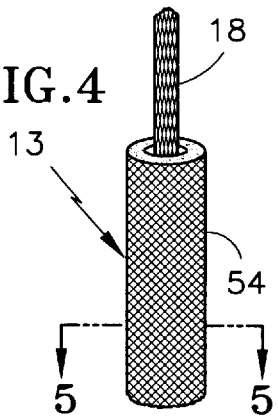
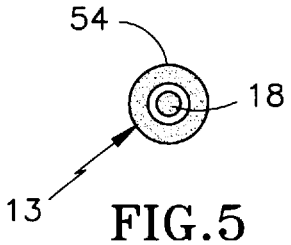
FIG.5
FIG.6
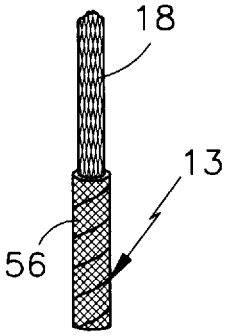
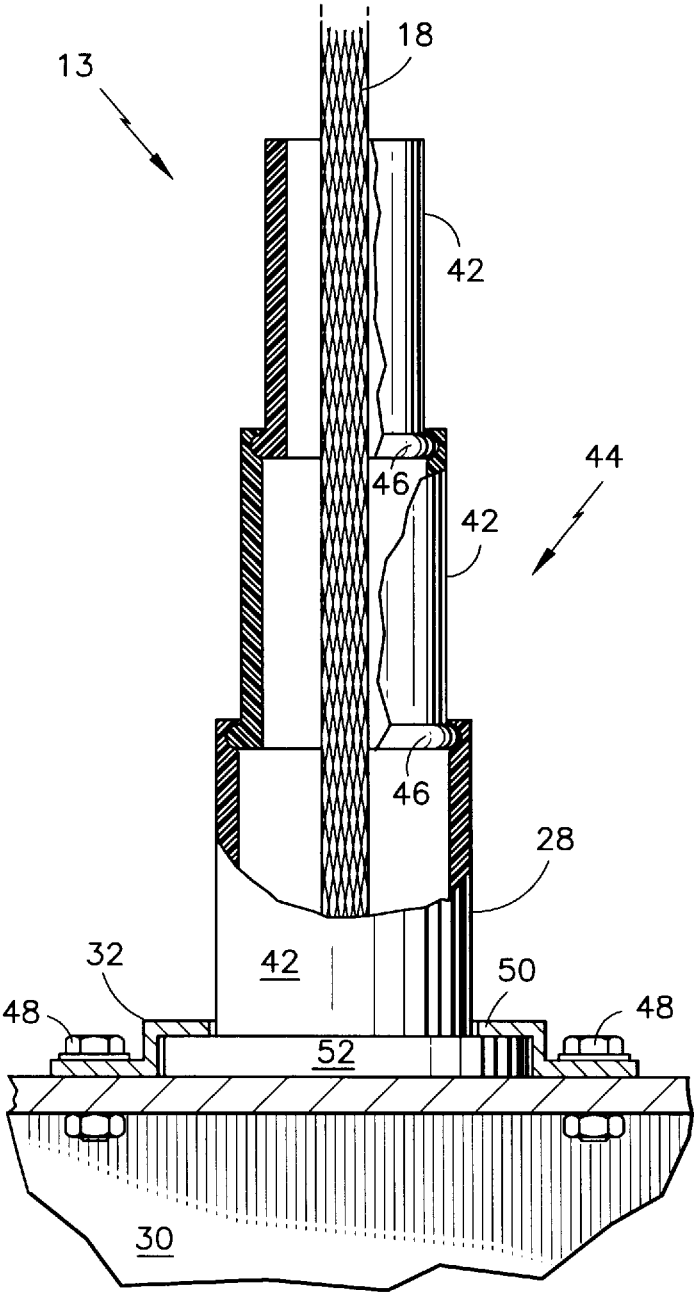
FIG.7

ELEVATOR ROPE PROTECTIVE DEVICE

TECHNICAL FIELD

The present invention relates to elevator systems, and more particularly to elevator systems having load-carrying ropes.

BACKGROUND OF THE INVENTION

A conventional traction type elevator includes a cab mounted in a car frame, a counterweight attached to the car frame via a plurality of ropes, and a machine driving a traction sheave that is engaged with the ropes. The ropes used in elevator applications have traditionally been steel wire ropes. Such ropes are inexpensive and durable. A limiting factor in the use of steel wire ropes, however, is their weight. The higher the rise of the building or hoistway, the longer and heavier the rope becomes. The rope gradually begins to dominate the load to be carried by the elevator system until the weight of the rope exceeds the tensile strength of the rope itself. Another disadvantage is the lubrication required for steel wire ropes. The steel wire ropes are treated with an oil lubrication that ultimately becomes deposited on the hoistway equipment, in the machine room, and in the pit of the hoistway.

There has recently been much interest in replacing the traditional steel wire ropes used in elevator applications with ropes formed from high strength, lightweight synthetic materials, such as aromatic polyamid or aramid materials. Lightweight ropes formed from these materials could potentially reduce the size of many elevator components, such as machines and brakes, and could extend the rise of elevators.

The use of such synthetic ropes in traction elevators poses many problems. One of the potential problems is the increased risk of inadvertent damage to the synthetic ropes. Typical aramid materials, such as KEVLAR, have high tensile strength, but the fibers of this type of synthetic rope are more easily abraded and fractured than traditional steel ropes. They are also vulnerable to solvents. A mechanic working in the vicinity of the synthetic ropes may inadvertently come into contact with the ropes with a tool or other abrasive object or with a liquid solvent. This contact may damage the fibers of the rope and reduce the load-carrying capabilities and the expected life of the rope, requiring premature replacement of the ropes.

One solution to this problem is to monitor the wear of the ropes to ensure prompt replacement of any worn ropes, such as suggested in commonly assigned U.S. patent application Ser. No. 08/781,944. This application discloses the use of a plurality of spaced inserts disposed within the rope. The inserts are monitored in various manners to detect elongation of the rope. A mechanism of this type may be used to determine when to discard and replace the ropes.

The above art notwithstanding, scientists and engineers under the direction of Applicant's Assignee are working to develop mechanisms to minimize the risk of damage occurring to elevator ropes.

DISCLOSURE OF THE INVENTION

According to the present invention, a protective device for an elevator system extends about a rope and extends upward from an elevator car.

As a result of the protective device, contact with the portion of the rope enclosed by the device is blocked. The advantage is that by blocking contact with the rope proximate to the car, the risk of damage caused by a person, such as a mechanic, who is present on the top of the car, is minimized. The top of the car may be the location of test and maintenance equipment for the elevator system. A mechanic using this test and maintenance equipment may inadvertently come into contact with the rope. The device provides a protective barrier between the mechanic, or his tools, and the rope.

The protective device may be formed in a variety of manners. In one embodiment, a sheath is formed from an abrasion resistant woven fiber material; in another embodiment, a sheath is formed from an abrasion resistant fiber tape; in a third embodiment, the protective device is a tubular structure. The material used to form the sheath may be metallic, non-metallic or a composite material.

In a particular embodiment, the protective device is defined by a tubular structure, and includes a clamp that is fastenable to the car. The tubular structure includes a lip that extends about one end of the tubular structure. The clamp engages the flange to retain the tubular structure to the car. The advantage of this embodiment is that it provides a simple mechanism to retain the protective device to the car.

In a particular configuration of this embodiment, the tubular structure includes frangible zones that, when the tubular structure is subjected to a sufficient buckling or compression load, fail. The benefit of this configuration is that in the event of an over-run of the elevator that exceeds the predetermined overhead space, the tubular structure will impact a grate installed between the traction sheave and the car. The force of the impact will fracture the tubular structure and prevent interference between the tubular structure and the sheave. In an alternative configuration, the tubular structure is formed from a telescoping tube having detent positions that hold the tube in the extended position under normal operating conditions. In the event of an impact with the grate, the force of the impact will overcome the retaining force and compress the tubular structure to avoid interference with the sheave.

The foregoing and other objects, features and advantages of the present invention become more apparent in light of the following detailed description of the exemplary embodiments thereof, as illustrated in the accompanying drawings.

BRIEF DESCRIPTION OF THE DRAWINGS

FIG. 2 is a front view of an elevator car having protective device formed from a tubular structure extending about the ropes and upward from the car.

FIG. 3 is partially cut-away view of a clamp for retaining the tubular structure to the car.

FIG. 4 is an alternative embodiment of the protective device.

FIG. 5 is a sectional view taken along line 5—5 of FIG. 4.

FIG. 6 is another alternative embodiment of the protective device.

FIG. 7 is an alternative embodiment of the tubular structure.

BEST MODE FOR CARRYING OUT THE INVENTION

Figure 1:
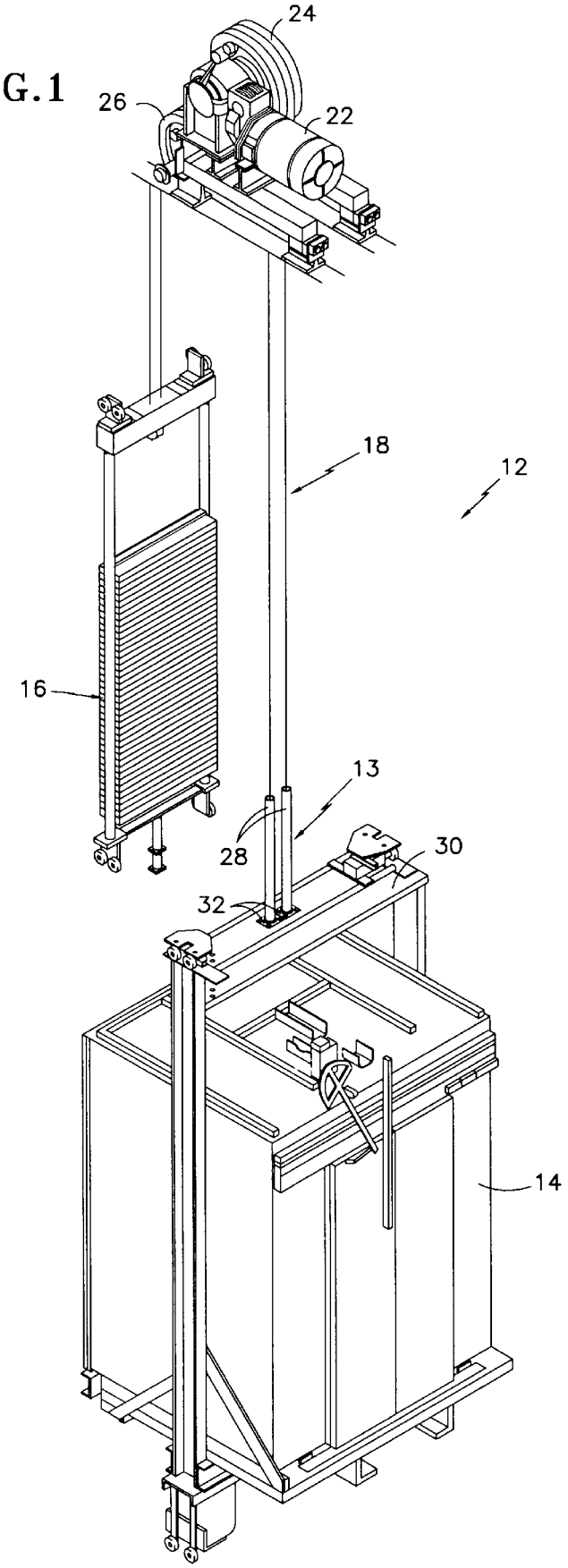
FIG. 1 is a perspective view of an elevator system.

Illustrated in FIG. 1 is an elevator system 12 having a protective device 13. The elevator system includes a car 14, a counterweight 16 that is connected to the car 14 by a pair of ropes 18, and a machine 22 having a traction sheave 24.

The ropes 18 extend over the traction sheave 24 and rotation of the traction sheave 24 moves the car 14 and counterweight 16 through the hoistway (not shown in FIG. 1). The ropes 18 are formed from a high strength non-metallic material, such as one of the aramid fiber materials. An example of such a material is known commercially as KEVLAR and available from DuPont-Nemours. The use of such lightweight ropes 18 minimizes the load that must be driven by the machine 22.

The protective device 13 includes a pair of tubular structures 28 extending upward from the cross-head 30 of the car 14. The tubular structures 28 are retained to the cross-head 30 by a clamp 32. Each tubular structure 28 is circumferentially spaced from and extends about one of the synthetic ropes 18. Although shown in FIG. 1 as an elevator system 12 having two ropes 18, it should be noted that number of ropes is dependant upon the specific elevator application and may include more ropes as needed. As a result, the number of tubular structures 28 will depend, in part, upon the number of ropes 18. It should also be apparent to one skilled in the art that a single tubular or elliptical structure may be used to encompass all ropes.

As shown more clearly in FIG. 2, each tubular structure 28 extends from the cross-head 30 to a height L1. The magnitude of L1 is selected to be of a length such that a normal person standing on the car 14 top or cross-head 30 would not come into contact with the ropes 18. A suggested value for L1 is eight feet, although in particular applications other values may be desired. The extension L1 of the tubular structures 28 is less than the overhead space L2 needed by the elevator system 12. The overhead space is defined as the necessary distance between the top of the car 14 and the ceiling 34 of the hoistway. For most applications, the height of the tubular structures 28 should be less than the overhead room to avoid interference between the tubular structures 28 and the traction sheave 24.

The tubular structures 28 are formed from a rigid, damage resistant material, such as a metallic material or hard plastic material. The material is selected such that it will block contact between the ropes 18 extending from the car 14 and a person standing on the car 14 top. For instance, a mechanic requires access to the top of the car 14 to perform routine maintenance on the elevator system 12. The protective device 13 avoids inadvertent contact between the ropes 18 and a tool carried or used by the mechanic as well as liquid solvents. Such contact, if it occurred, may damage some of the fibers of the ropes 18 and result in premature replacement of the ropes 18.

In the event of an over-run by the car 14, i.e., the car 14 rising into the overhead space, the tubular structures 28 include a frangible zone 36 and the ceiling includes a grate 38. The frangible zone 36 is a predetermined fracture point for the structures. The grate 38 includes openings 40 that permit the ropes 18 to pass through but which are too small to permit the tubular structures 28 to pass through. Upon impact of the tubular structures 28 with the grate 38, the frangible zones 36 fracture and the tubular structure 28 breaks. Breaking the tubular structure 28 prevents damaging interference between the traction sheave 24 and the protective device 13 in the rare event of an over-run by the car 14.

An alternative embodiment for preventing damaging contact between the tubular structure 28 and the traction sheave 24 is shown in FIG. 7. In this embodiment, the tubular structure 28 is formed from a plurality of pieces 42 that form a telescoping tube 44. The telescoping tube 44 includes means to retain the tube 44 in the extended position. The means includes detent positions 46 formed between adjacent pieces 42 of the telescoping tube 44. The detent positions 46 are such that the force to compress the extended tube 44 is greater than that which would be incurred during normal operating conditions and less than the impact forces that would be caused by contact between the tube 44 and the grate 38 in the event of an over-run. In this way, the telescoping tube 44 remains extended to perform its protective function while accommodating the rare instances of an over-run without interfering with the traction sheave 24.

The clamp 32 defines means to retain the protective device 13 to the car 14. The clamp 32 for each tubular structure 28 is shown more clearly in FIG. 3. The clamp 32 extends about the lower end of the tubular structure 28 and includes a plurality of fasteners 48 and a flange 50 that engages a lip 52 on the end of the tubular structure 28. The fasteners 48 are engaged with the cross-head 30 to retain the clamp 32 to the car 14. Engagement between the flange 50 and the lip 52 retains the tubular structures 28 to the car 14. Although shown as having an individual clamp for each tubular structure, it should be apparent that a single clamp may be used for the plurality of tubular structures or that multiple clamps may be used for each tubular structure.

An alternate embodiment of the protective device 13 is illustrated in FIGS. 4 and 5. In this embodiment, the protective device 13 is a sheath 54 formed from an abrasion resistant woven fiber material. The fiber material may be woven from metallic or non-metallic fibers. The sheath 54 extends about the rope 18 to provide a protective barrier or layer. In the event of damaging contact occurring, only the sheath 54 is damaged and the integrity of the rope 18 is maintained. An advantage of this embodiment is that the sheath 54 minimizes the risk of damage to the traction sheave 24 in the event that an over-run of the car 14 results in contact between the protective device 13 and the traction sheave 24. As shown in FIG. 5, the sheath 54 is spaced from the rope 18. This spacing permits the rope 18 to stretch during the operation of the elevator system 12 without interference from the sheath 54, which is not loaded and may have a different modulus of elasticity. As an alternative, if a material for the sheath is selected having a comparable or lower modulus of elasticity, the sheath may be bonded directly to the exterior surface of the rope without concern for delamination.

Another alternate embodiment is illustrated in FIG. 6. In this embodiment, the protective device 13 is a tape 56 formed from an abrasion resistant woven fiber material. The tape 56 is spirally wrapped around and adhered to the rope 18 to provide a protective barrier or layer. In the event of damaging contact occurring, only the tape 56 is damaged and the integrity of the rope 18 is maintained. An advantage of this embodiment is that the tape 56 may easily be applied during installation of the elevator system 12, and may be easily removed and re-applied if the ropes 18 are changed. In addition, as with the embodiment of FIGS. 4 and 5, the tape 56 minimizes the risk of damage to the traction sheave 24 in the event that an over-run of the car 14 results in contact between the protective device 13 and the traction sheave 24.

Although shown and described as particularly advantageous for elevator systems that use synthetic ropes, the invention may also have application to elevator systems having other types of ropes, including metallic ropes.

Although the invention has been shown and described with respect to exemplary embodiments thereof, it should be understood by those skilled in the art that various changes, omissions, and additions may be made thereto, without departing from the spirit and scope of the invention.

What is claimed is:

1. A protective device for an elevator system, the elevator system including a car suspended by a rope, the protective device extending about the rope and extending upward from the car such that the portion of the rope enclosed by the protective device is protected from damaging contact with other objects.

2. The protective device according to claim 1, wherein the protective device includes a sheath formed from a woven fiber material that is abrasion resistant.

3. The protective device according to claim 2, wherein the fiber material is metallic.

4. The protective device according to claim 1, wherein the protective device includes a tape formed from an abrasion resistant material that is wound around the rope.

5. The protective device according to claim 4, wherein the tape is formed from a metallic material.

6. The protective device according to claim 1, wherein the protective device includes a tubular structure formed from an abrasion resistant material.

7. The protective device according to claim 6, wherein the abrasion resistant material is metallic.

8. The protective device according to claim 6, further including a clamp that is fastenable to the car, the clamp providing means to retain the tubular structure to the car.

9. The protective device according to claim 8, wherein the tubular structure includes a lip extending about one end of the tubular structure, and wherein the clamp engages the lip to retain the tubular structure to the car.

10. The protective device according to claim 1, wherein the protective device extends upward from the car to a distance greater than or equal to eight feet.

11. The protective device according to claim 1, wherein the car is disposed for vertical motion within a hoistway having a ceiling, wherein the separation between the top of the car and the ceiling during normal operation of the elevator defines an overhead space, and wherein the protective device extends upward from the car to a distance less than the overhead space.

12. The protective device according to claim 10, wherein the car is disposed for vertical motion within a hoistway having a ceiling, wherein the separation between the top of the car and the ceiling during normal operation of the elevator defines an overhead space, and wherein the protective device extends upward from the car to a distance less than the overhead space.

13. The protective device according to claim 1, wherein the elevator system further includes a traction sheave engaged with the rope, and the protective device further including means to prevent interference between the sheath and the traction sheave.

14. The protective device according to claim 13, wherein the means to prevent interference includes a frangible zone disposed in the protective device and a grate disposed proximate to the traction sheave, the grate having openings that permit passage of the ropes and block passage of the tubular structures.

15. The protective device according to claim 13, wherein the means to prevent interference includes the tubular structure being formed from a telescoping tube and a grate disposed proximate to the traction sheave, the grate having opening that permit passage of the rope and blocks passage of the telescoping tube.

* * * * *